United States Patent [19]

Junghans

[11] 4,050,998

[45] Sept. 27, 1977

[54] ELECTROLYTIC REDUCTION OF AROMATIC STEROIDS

[75] Inventor: Klaus Junghans, Berlin, Germany

[73] Assignee: Schering Aktiengesellschaft, Berlin & Bergkamen, Germany

[21] Appl. No.: 693,849

[22] Filed: June 8, 1976

Related U.S. Application Data

[63] Continuation-in-part of Ser. No. 489,160, July 17, 1974, abandoned.

[30] Foreign Application Priority Data

July 18, 1973 Germany ..... 2337155

[51] Int. Cl.[2] ..... C25B 3/04

[52] U.S. Cl. ..... 204/59 R

[58] Field of Search ..... 204/59 R, 72, 73 R

[56] References Cited

U.S. PATENT DOCUMENTS

| | | | |
|---|---|---|---|
| 3,444,057 | 5/1969 | Throop | 204/59 R |
| 3,469,008 | 9/1969 | Schmidt | 424/243 |
| 3,492,207 | 1/1970 | Yang et al. | 204/59 R |
| 3,720,694 | 3/1973 | Junghans et al. | 260/397.5 |

*Primary Examiner*—F.C. Edmundson

*Attorney, Agent, or Firm*—Millen & White

[57] ABSTRACT

$\Delta^{1,3,5(10)}$ steroids are electrochemically reduced to $\Delta^{2,5(10)}$ steroids in an improved manner by conducting the reduction in liquid ammonia in the presence of an electrolytic salt consisting of an alkali metal salt of a strong acid, when the electrolysis is conducted in a divided cell, and consisting of an alkali metal salt of a weak acid or a mixture of an alkali metal salt of a weak acid and of a strong acid, when the electrolysis is conducted in an undivided cell.

12 Claims, No Drawings

ELECTROLYTIC REDUCTION OF AROMATIC STEROIDS

This is a continuation-in-part of copending application Ser. No. 489,160, filed July 17, 1974, now abandoned.

BACKGROUND OF THE INVENTION

This invention relates to a process for the production of $\Delta^{2,5(10)}$ steroids from $\Delta^{1,3,5(10)}$ steroids by electrochemical reduction.

In U.S. Pat. 3,720,694 and Fed. Rep. of Germany Pat. No. P 20 63 101.0, Horst Ropke and I disclose a process for the electrolytic reduction in liquid ammonia of 19-nor-$\Delta^{1,3,5(10)}$-steroids containing a further reducible double bond. The electrolysis is conducted in an undivided (one-piece) cell employing an alkali metal salt or an alkaline earth salt of a strong acid or an onium complex salt. This results in the reduction of nonaromatic unsaturated groups but the aromatic A-ring is not affected.

The electrochemical reduction of simple aromatics in liquid ammonia has been described previously. See, for example, U.S. Pat. Nos. 3,493,477 and 3,488,266. The electrochemical reduction of $\Delta^{1,3,5(10)}$ aromatic steroids to the corresponding $\Delta^{2,5(10)}$ steroids in methylamine or in other alkyl amine as the solvent is known. See German Patent No. 1,266,300. However, this process has the disadvantage that the amines utilized as the solvent must be separated from the final product after the electrolysis by distillation under reduced pressure or by precipitation with other liquids. Also, due to the low conductivity of the reaction mixture, the current consumption is very high, and a correspondingly strong evolution of heat occurs. This heat must be removed in order to conduct the process on a technical scale.

Similarly, U.S. Pat. No. 3,444,057 also discloses the electrolytic reduction of $\Delta^{1,3,5(10)}$-aromatic steroids to $\Delta^{2,5(10)}$-steroids using lithium chloride, bromide or iodide as the electrolytic salt. Although liquid ammonia is contemplated as a solvent at Col. 1, line 47, of U.S. Pat. No. 3,444,057, in all of the examples ethylenediamine is employed as a solvent and the reduction is conducted in a single compartment (undivided) cell. Had the inventor actually employed liquid ammonia, he would have found that liquid ammonia is not the equivalent of ethylenediamine in such an electrolytic process and substitution of liquid ammonia as the solvent would have rendered his process inoperable to produce the desired $\Delta^{2,5(10)}$-steroids, because in a single compartment cell, i.e., an undivided cell, using lithium chloride, bromide or iodide as electrolytic salt and liquid ammonia as solvent does not result in the reduction of the aromatic ring of an aromatic steroid.

This invention is directed to a process for the electrochemical reduction of $\Delta^{1,3,5(10)}$ aromatic steroids to a $\Delta^{2,5(10)}$ steroid wherein the solvent can be separated from the final product without great technical effort, wherein less current is required and accordingly the amount of heat produced is not high.

SUMMARY OF THE INVENTION

According to this invention, $\Delta^{1,3,5(10)}$ steroids are electrochemically reduced to $\Delta^{2,5(10)}$ steroids by conducting the reduction in liquid ammonia in the presence of an electrolytic salt consisting of an alkali metal salt of a strong acid, when the electrolysis is conducted in a divided cell, and consisting of an alkali metal salt of a weak acid or a mixture of an alkali metal salt of a weak acid and of a strong acid, when the electrolysis is conducted in an undivided cell.

DETAILED DISCUSSION

Although the electrochemical reduction of simple aromatics in liquid ammonia is known, the smooth course of the electrolysis could not be expected in case of the steroids which are of a complicated structure and are optionally substituted by functional groups. It is furthermore surprising that the aromatic ring is reduced if the process according to U.S. Pat. No. 3,720,644 and DOS No. 2,063,101 is conducted in a divided cell, rather than in an undivided cell, or if that process is conducted in an undivided cell an alkali metal salt of an acid which is weak in liquid ammonia, optionally in admixture with an alkali metal salt of a strong acid, is employed as the electrolytic salt.

ELECTROLYSIS IN A DIVIDED CELL

When the electrolysis is conducted in a divided cell, the conducting salt employed is an alkali metal salt, e.g., lithium, sodium or potassium salt, of a strong acid, for example, a halogenide, e.g., chloride or bromide. Complex anions, e.g., tetrafluroborate, sulfate and perchlorate can also be employed.

ELECTROLYSIS IN AN UNDIVIDED CELL

When the electrolysis is conducted in an undivided cell, the conducting salt employed is either (a) an alkali metal salt, e.g., lithium, sodium or potassium salt, of an acid (the term "acid" being used in the generic sense of a proton donor) which is weakly acidic in ammonia, e.g., aniline, hydrazine, alcohol and water, viz., alkali metal analides, hydrazides, alcoholates, e.g., alkanols of 1–8 carbon atoms and hydroxides, or (b) a mixture of such an alkali metal salt of a weak acid and an alkali metal salt of a strong acid, such as is employed in a divided cell.

The electrolysis in an undivided cell preferably is conducted employing a mixture of an alkali salt of a strong acid. However, it is the salt of the weak acid, not the salt of the strong acid, which is critical to achieving the reduction of the $\Delta^{1,3,5(10)}$-aromatic ring to a $\Delta^{2,5(10)}$-group. The ratio of weak acid salt to strong acid salt is not critical and less or more of the latter than the former can be employed.

In both divided and undivided cells, the concentration ratio of the electrolyte salt to the steroid to be reduced has no effect on the reduction and can be varied within wide limits. Steroid concentrations, e.g., of from 0.01 to 0.5, preferably 0.1 to 0.2 moles per liter of liquid ammonia and conductive salt concentrations of, e.g., from 0.001 to saturation, preferably 0.01 to 0.5 moles per liter can be employed.

The reduction also is not affected if a part of a reactant is undissolved, i.e., if a saturated solution is employed.

Liquid ammonia is the solvent for the reduction. However, minor amounts of other solvents can also be added, insofar as they are inert with respect to the reactants. These solvents can be employed as solubilizers between the ammonia and the steroid to be reduced. Examples of such solvents are ethers, e.g., diethyl ether, tetrahydrofuran, and dioxane; and acid derivatives, e.g., ethyl acetate, acetonitrile, and dimethylformamide, and dimethyl sulfoxide.

The divided cell employed in the process is of a conventional structure wherein the electrode compartments are separated by a porous material, such as, for example, porous glass, clay diaphragms, or asbestos fiber, or by an ion exchanger membrane.

The electrolysis can be carried out with any type of current, e.g., alternating current, direction, unstabilized alternating current, direct current and modulated direct current. The conditions of the electrolysis, such as voltage, amperage, current density, electrode surface, as well as pressure and temperature, are widely variable. Preferably, the process is conducted at a current density of 0.1 - 5 A/cm$^2$ and at a temperature of $-50°$ C to the boiling temperature of the reaction mixture. However, it is also possible to utilize elevated pressure. The electrode material is likewise not critical. The material need only conduct the current and be stable under the conditions of the electrolysis. Such requirements are met, e.g., by gold, silver, mercury, platinum, aluminum, tungsten carbide and graphite. The procedure of the electrolysis can be effected continuously of discontinuously.

Examples of starting steroids are $\Delta^{1,3,5(10)}$-3-hydroxytrienes of the estrane, 18-methyl-estrane, 19-norpregnane, and 19-norcholestane series, preferably in the form of their ethers, e.g., 3-alkyl, preferably of 1-8 carbon atoms, e.g., methyl and ethyl, 3-cycloalkyl, preferably of 3-8 carbon atoms and 3-6 ring members, e.g., cyclopentyl and cyclohexyl, and 3-aralkyl, 3g., of 7-12 carbon atoms, e.g., benzyl and phenethyl, ethers.

In addition to the double bonds in the aromatic A-ring, these compounds can also contain one or more conjugated C=C double bonds, such as, for example, as $\Delta^{6}$-, $\Delta^{8}$-, or $\Delta^{9(11)}$- and/or other reducible groupings, such as, for instance, carbonyl groups in the 6-, 11-, or 20-position, nitro or imino groups >C=NR, wherein R is hydrogen, hydroxy, alkyl, aryl, or aralkyl. These double bonds are concomitantly reduced during the course of the process of this invention, while an exocyclic multiple bond, such as the 17α-ethinyl group, is reduced to the double bond. Such an isolated C=C double bond is then not reduced any further. The steroid skeleton can furthermore contain other conventional groups, such as, for example, alkyl of 1-4 carbon atoms, preferably methyl, e.g., in the 1-, 6-, 7-, or 16-position, and free or functionally modified, e.g., esterified or etherified hydroxy groups, e.g., in the 1-, 3-, 6-, 7-, 11-, 15-, 16-, 17-, or 21-position. A 17-alkyl group can have the α- or β-configuration. A preferred class of starting steroids are those of the formula

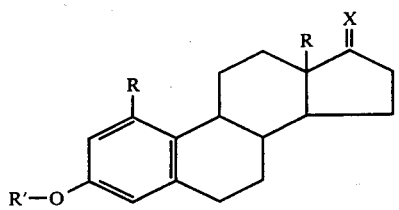

wherein R is H or $CH_3$, R' is alkoxy of 1-8 carbon atoms or cycloalkoxy of 3-8 carbon atoms and X is keto, β-hydroxy-α-H, β-hydroxy-α-($CH_3$—CH=$CH_2$ or —C=CH, β-alkoxy-α-H or β-cycloalkoxy-α-H wherein alkoxy and cycloalkoxy are as defined herein), alkylenedioxy of 2-8 carbon atoms forming with the 17-position carbon atom a 5 or 6 membered ring or o-phenylenedioxy, α-H,-β-(2'-alkylenedioxy-propyl) wherein alkylenedioxy is as defined herein, α-H,β-(2'-o-phenylenedioxy-propyl) or

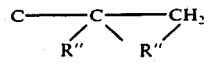

wherein R'' as alkylenedioxy is defined herein or o-phenylenedioxy.

Specific examples of such compounds are:

estrone methyl ether, 3-methoxy-1,3,5(10),8-estratetraen-17β-ol, 3-methoxy-18-methyl-1,3,5(10),8-estratetraen-17-one, 3-methoxy-1,3,5(10)-pregnatrien-17α-ol -20-ethylene ketal, 3-methoxy-1,3,5(10),9(11)-estratetraen-17β-ol, 3-ethoxy-17α-methylestra-1,3,5(10)-trien-17β-ol, 3-cyclohexyloxy-17αvinylestra-1,3,5(10)-trien-17β-ol, 3-methoxy-19-nor-cholesta-1,3,5(10)-triene, 3-methoxy-1-methyl-19-nor-20-ethylenedioxy-pregna-1,3,5(10)-triene, 3-methoxy-17α,20;20,21-bis(methylenedioxy)-19-nor-pregna-1,3,5(10)-triene, 3-methoxy-17-ethylenedioxy-1,3,5(10)-estratriene, and 3-methoxy-17β-tert.-butoxy-1,3,5(10),9(11)-estratetraene.

The $\Delta^{2,5(10)}$ steroids prepared according to the process of this invention are intermediates for the production of valuable pharmaceuticals. For example, by acid hydrolysis of the $\Delta^{2,5(10)}$-3-enol ether thus produced, a $\Delta^{4}$-3-ketone is produced.

For example, 19-nor-testosterone is produced in good yields from 3-methoxy-2,5(10)-estradiene-17β-ol by mild hydrolysis with diluted hydrochloric acid (Wilds et al., J.Amer.Chem.Soc., 75 (1953) 5360; ibid. 5366).

The well known progestagen 17β-hydroxy-17α-ethinyl-18-methyl-4-estrene-3-one (norgestrel) is produced by Oppenauer oxidation of 3-methoxy-18-methyl-2,5(10)-estradiene-17β-ol with aluminum isopropoxide and cyclohexanone (e.g., Djerassi, Organic Reactions, 6 (1951) 207). The thus-obtained 3-methoxy-18-methyl-2,5(10)-estradiene-17-one is reacted with acetylene in the presence of potassium tertiary butylate and tetrahydrofuran; the crude reaction product is then hydrolyzed by concentrated hydrochloric acid according to U.S. Pat. No. 3,759,961.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

EXAMPLE 1 (divided cell)

1.0 g. of estrone methyl ether is dissolved in 50 ml. of tetrahydrofuran and 200 ml. of liquid ammonia and electrolyzed in the presence of 2.5 g. of lithium perchlorate in a cell divided by a porous glass plate for 1.5 hours at 1 ampere (cathode, stainless steel; anode, graphite). After the solvent has been evaporated, the mixture is combined with water and filtered, thus obtaining 0.9 g. of 3-methoxy-2,5(10)-estradien-17β-ol, m.p. 114°–116° C. (methanol).

EXAMPLE 2 (undivided cell)

2.0 g. of 3-methoxy-1,3,5(10),8-estratetraen-17β-ol is electrolyzed in 200 ml. of liquid ammonia and 20 ml. of ethanol in the presence of 2 g. of lithium ethylate and 0.5 g. of lithium anilide for 3 hours in an undivided cell between an aluminum cathode and a platinum anode, with a current density of 2.5 A/cm². After the reaction mixture has been worked up, 1.8 g. of 3-methoxy-2,5(10)-estradien-17β-ol is isolated, m.p. 110° C.

EXAMPLE 3 (undivided cell)

0.5 g. of d,1-3-methoxy-18-methyl-1,3,5(10),8-estratetraen-17-one is electrolyzed in 250 ml. of liquid ammonia in an autoclave at +30° C. between a stainless steel cathode and a graphite anode in the presence of 2.0 g. of sodium chloride and 2.0 g. of sodium ethylate at 2 amperes. After the reaction is terminated, the solvent is evaporated by gentle pressure equalization, and the residue is mixed with water and filtered. Yield: 0.4 g. of d,1-3-methoxy-18-methyl-2,5(10)-estradien-17β-ol, m.p. 98°–100° C.

EXAMPLE 4 (divided cell)

1.0 g. of 3-methoxy-1,3,5(10)-pregnatrien-17α-ol -20-ethylene ketal is electrolyzed in a cell divided by a cation exchanger membrane in 200 ml. of liquid ammonia in the presence of 2.5 g. of sodium perchlorate on an aluminum cathode. After the reaction mixture has been worked up, 1.0 g. of 3-methoxy-2,5(10)-pregnadien-17α-ol -20-ethylene ketal is obtained, m.p. 172°–175° C.

EXAMPLE 5 (undivided cell)

1.0 g. of 3-methoxy-1,3,5(10),9(11)-estratetraen-17β-ol is dissolved in 25 ml. of dioxane and added to a decolorized mixture of 0.5 g. of lithium in 200 ml. of ammonia, 5 g. of lithium chloride, 15 ml. of ethanol, and 5 ml. of aniline. After the electrolysis at 1 ampere between 2 platinum electrodes in an undivided cell has been terminated and the ammonia has been evaporated, the mixture is combined with a large amount of water and filtered, thus isolating 0.8 g. of 3-methoxy-2,5(10)-estradien-17β-ol, m. p. 108°–112° C.

EXAMPLE 6 (divided cell)

1.0 g. of 3-methoxy-17-ethylenedioxy-1,3,5(10)-estratriene in 10 ml. of ethanol is added to 200 ml. of liquid ammonia, 2 g. of lithium chloride, and electrolyzed for 1 hour at 1 ampere on a tungsten carbide electrode in a cell divided by a cation exchanger membrane. After the mixture has been worked up, 0.9 g. of 3-methoxy-17-ethylenedioxy-2,5(10)-estradiene is produced, m.p. 115°–120° C.

EXAMPLE 7 (divided cell)

1.0 g. of 3-methoxy-17β-tert.-butoxy-1,3,5(10),9(11)-estratetraene is dissolved in 4 ml. of aniline and 3 ml of ethanol, added to 150 ml. of liquid ammonia, 5 g. of lithium perchlorate and electrolyzed for 2 hours at 1 ampere on a mercury electrode in a cell divided by a porous glass plate. After the mixture has been worked up, the crude product (1.1 g.) is dissolved in ethanol and heated with 3 ml. of concentrated hydrochloric acid. By gently adding water, 0.6 g. of nortestosterone is obtained after cooling which, after recrystallization from isopropyl ether, has a melting point of 108°–110° C.

EXAMPLE 8 (divided cell)

In an H-cell divided by an anion exchange membrane (producer: Ionics, 111 BZL 183) a solution of 1 g. of 3-methoxy-1,3,5(10)-estratrien-17β-ol (estradiol methyl ether) in 10 ml. of tetrahydrofuran and 2 ml. of tert.-butanol is electrolyzed under cooling to −40° C. on a stainless steel cathode (10 cm²) in a mixture of liquid ammonia and 4 g/l. of lithium chloride at 1 ampere with the use of a graphite anode. After 1 hour, a catholyte is evaporated to dryness after the ammonia has been vaporized; the residue is combined with water, and the reaction product is filtered off. After drying, the colorless residue (0.95 g.) contains, according to analysis by gas chromatography and comparison of the retention times with authentic material, 92% of 3-methoxy-2,5(10)-estradien-17β-ol in addition to 4% of starting material.

COMPARATIVE EXAMPLE 8*a* (undivided cell)

A solution of 1 g. of estradiol methyl ether in 10 ml. of THF and 2 ml. of tert.-butanol is electrolyzed for 1 hour at 1 ampere in 250 ml. of liquid ammonia with the use of 1 g. of LiCl in an undivided cell between a stainless steel cathode (10 cm²) and a graphite anode. After the ammonia has been evaporated, the residue is filtered (0.95 g.); according to GC and mixed melting point, this residue consists of unchanged estradiol methyl ether.

It is apparent from Example 8 and Comparative Example 8*a* that electrolysis in liquid ammonia in the presence of LiCL in a divided cell yields the desired product whereas in an undivided cell, reduction is not achieved.

EXAMPLE 9 (undivided cell)

The procedure of Example 8*a* is followed, except that a mixture of 1 g. of LiCl and 3 g. of lithium tert.-butylate is employed as electrolytic salt. The working-up step yields a residue (0.9 g.) having a melting point of 110°–112° C. and containing 82% of 3-methoxy-2,5(10)-estradien-17β-ol in addition to 12% of starting material.

As shown by Example 9, the inoperable reduction in an undivided cell of Comparative Example 8*a* becomes operable in the presence of lithium tert.-butylate.

EXAMPLE 10 (divided cell)

One gram of 3-methoxy-1,3,5(10)-estratrien-17β-ol is electrolyzed together with 10 ml. of THF and 2 ml. of tert.-butanol in 300 ml. of liquid ammonia with 5 g. of $NaClO_4$ in a divided cell (cation exchanger "Nafion X R 475" of DuPont) for 2 hours on a stainless steel electrode (16 cm²) at 1 ampere with the use of a graphite anode, in the same electrolyte. After the ammonia has been evaporated, the residue is concentrated by evaporation, combined with water and filtered. The residue (0.9 g.), m.p. 105°–110° C., contains according to GC and NMR analysis 90% of 3-methoxy-2,5(10)-estradien-17β-ol in addition to 6% of starting material.

As shown by Example 10, reduction in a divided cell is also accomplished in the presence of $NaClO_4$ but, like Comparative Example 8*a*, the same reduction is inoperable in an undivided cell, as shown by Comparative Example 10*a*.

COMPARATIVE Example 10*a* (undivided cell)

One gram of estradiol methyl ether is dissolved in 10 ml. of THF and 2 ml. of tert.-butanol and then electrolyzed for 1 hour at 1 ampere in 200 ml. of ammonia and 2 g. of $NaClO_4$ in an undivided cell between a stainless steel cathode and a graphite anode. After the working-up step as described above, the residue (0.95 g.) consists of unreacted starting material according to GC and NMR analysis.

EXAMPLE 11 (undivided cell)

The electrolysis is carried out as described in Comparative 10*a*, but in the additional presence of 3 g. of sodium tert.-butylate. The working-up step yields 0.85 g. of a reaction product, m.p. 105°–111° C. containing, according to GC and NMR analysis, 85% of 3-methoxy-2,5(10)-estradien-17$\beta$-ol in addition to 10% of starting material.

As shown in Example 11, reduction is achieved with a mixture of $NaClO_4$ and sodium tert.-butylate in an undivided cell. Like Example 10, the desired reduction in a divided cell is achieved with $LiClO_4$, as shown by Example 12.

EXAMPLE 12 (divided cell)

One gram of estradiol methyl ether in 10 ml. of THF and 2 ml. of tert.-butanol is electrolyzed in a cell divided by a cation exchange membrane ("Nafion X R 475" DuPont) in liquid ammonia with 5 g. of $LiClO_4$ for 2 hours on a stainless steel electrode (16 $cm^2$) at 1 ampere (counter electrode: graphite). After evaporation of the ammonia and concentration to dryness, the residue (0.9 g.), m.p. 102°–105° C., contains according to GC and NMR analysis 89% of 3-methoxy-2,5(10)-estradien-17$\beta$-ol in addition to 7% of starting material.

Like Comparative Example 10*a*, reduction is not achieved in an undivided cell in the presence of $LiClO_4$, as shown by Comparative Example 12*a*.

COMPARATIVE EXAMPLE 12*a* (undivided cell)

One gram of estradiol methyl ether is electrolyzed in 10 ml. of THF and 2 ml. of tert.-butanol in 200 ml. of ammonia and 2 g. of $LiClO_4$ in an undivided cell between a stainless steel cathode and a graphite anode (respectively 16 $cm^2$) for 1 hour at 1 ampere. After the working-up step has been completed, the residue (0.9 g.) consists of unreacted starting material.

Like Example 11, reduction is achieved in the presence of lithium tert.-butylate, as shown by Example 13.

EXAMPLE 13 (undivided cell)

The electrolysis is conducted as described in Comparative Example 12*a* in the additional presence of 3 g. of lithium tert.-butylate. The working-up steps reveal that the residue (0.85 g.), m.p. 100°–106° C., contains according to GC and NMR analysis 84% of 3-methoxy-2,5(10)-estradien-17$\beta$-ol in addition to 10% of starting material.

The preceding examples can be repeated with similar success by substituting the generically and specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the electrolytic reduction of $\Delta^{1,3,5(10)}$ steroids to $\Delta^{2,5(10)}$ steroids which comprises subjecting a $\Delta^{1,3,5(10)}$ steroid to electrochemical reduction wherein the solvent consists of liquid ammonia and wherein the electrolyte consists of an alkali metal salt of a strong acid, when the electrolysis is conducted in a divided cell, and consists of an alkali metal hydroxide or alkali metal salt of a weak acid, or of a mixture of an alkali metal hydroxide or alkali metal salt of a weak acid and an alkali salt of a strong acid, when the electrolysis is conducted in an undivided cell.

2. A process according to claim 1 wherein the reduction is conducted in a divided cell.

3. A process according to claim 2 wherein the electrolyte is an alkali metal chloride, bromide, tetrafluoroborate, sulfate or perchlorate.

4. A process according to claim 3 wherein the electrolyte is lithium chloride.

5. A process according to claim 3 wherein the reduction is conducted at a current density of 0.1 – 5 A/$cm^2$ and at a temperature of −50° C. to the boiling temperature of the reaction mixture at a steroid concentration of from 0.01 to 0.5 moles per liter and a salt concentration of from 0.001 moles per liter to saturation.

6. A process according to claim 1 wherein the reduction is conducted in an undivided cell.

7. A process according to claim 6 wherein the electrolyte is an alkali metal anilide, hydrazide, or alcoholate.

8. A process according to claim 6 wherein the electrolyte is lithium ethylate or sodium ethylate.

9. A process according to claim 6 wherein the reduction is conducted at a current density of 0.1 – 5 A/$cm^2$ and at a temperature of −50° C. to the boiling temperature of the reaction mixture at a steroid concentration of from 0.01 to 0.5 moles per liter and an electrolyte concentration of from 0.001 moles per liter to saturation.

10. A process according to claim 6 wherein the electrolyte is a mixture of (a) an alkali metal anilide, hydrazide, alcoholate or hydroxide, and (b) an alkali metal salt of a strong acid.

11. A process according to claim 10 wherein (a) is lithium ethylate or sodium ethylate.

12. A process according to claim 10 wherein (b) is an alkali metal chloride.

* * * * *